US008333611B2

(12) United States Patent
Perndl et al.

(10) Patent No.: US 8,333,611 B2
(45) Date of Patent: Dec. 18, 2012

(54) COAXIAL PLUG-CONNECTOR PART WITH THERMAL DECOUPLING

(75) Inventors: Werner Perndl, Vaterstetten (DE); Markus Leipold, Isen (DE)

(73) Assignee: Rohde & Schwarz GmbH & Co. KG, Munich (DE)

( * ) Notice: Subject to any disclaimer, the term of this patent is extended or adjusted under 35 U.S.C. 154(b) by 13 days.

(21) Appl. No.: 12/937,954

(22) PCT Filed: Mar. 11, 2009

(86) PCT No.: PCT/EP2009/001735

§ 371 (c)(1),
(2), (4) Date: Oct. 14, 2010

(87) PCT Pub. No.: WO2009/127302

PCT Pub. Date: Oct. 22, 2009

(65) Prior Publication Data

US 2011/0065318 A1 Mar. 17, 2011

(30) Foreign Application Priority Data

Apr. 15, 2008 (DE) ..... 10 2008 018 810
May 5, 2008 (DE) ..... 10 2008 022 100

(51) Int. Cl.
*H01R 9/05* (2006.01)

(52) U.S. Cl. ..... 439/578

(58) Field of Classification Search ..... 439/322, 439/578, 320, 323, 314
See application file for complete search history.

(56) References Cited

U.S. PATENT DOCUMENTS

| | | | | |
|---|---|---|---|---|
| 4,111,514 | A | 9/1978 | Brishka | |
| 4,801,274 | A | 1/1989 | Royce | |
| 5,462,359 | A | 10/1995 | Reichl | |
| 5,667,405 | A * | 9/1997 | Holliday | 439/585 |
| 6,468,100 | B1 | 10/2002 | Meyer | |
| 7,189,114 | B1 | 3/2007 | Burris | |
| 7,666,003 | B2 | 2/2010 | Klinger | |
| 8,016,605 | B2 * | 9/2011 | Montena et al. | 439/322 |
| 8,025,518 | B2 * | 9/2011 | Burris et al. | 439/322 |
| 8,123,554 | B2 * | 2/2012 | Leipold et al. | 439/578 |

FOREIGN PATENT DOCUMENTS

| | | | |
|---|---|---|---|
| DE | 1 818 144 | U | 9/1960 |
| DE | 195 43 511 | C1 | 2/1997 |
| DE | 10 2004 030 696 | A1 | 1/2006 |
| DE | 10 2006 005 940 | B3 | 9/2007 |
| EP | 0 215 308 | A2 | 3/1987 |
| EP | 0 327 204 | B1 | 8/1989 |
| EP | 1 427 069 | A1 | 6/2004 |

OTHER PUBLICATIONS

International Search Report mailed Aug. 7, 2009, in corresponding International Application No. PCT/EP2009/001735, filed Mar. 11, 2009.

* cited by examiner

*Primary Examiner* — Phuong Dinh
(74) *Attorney, Agent, or Firm* — Christensen O'Connor Johnson Kindness PLLC

(57) ABSTRACT

The invention relates to a coaxial plug connector element comprising a metal union nut that is arranged in a rotatable manner on a metal outer conductor and can be screwed onto the external thread of the counter plug connector element. Means for the thermal decoupling of the plug connector element are provided on the inside of the device.

11 Claims, 2 Drawing Sheets

COAXIAL PLUG-CONNECTOR PART WITH THERMAL DECOUPLING

The invention relates to a coaxial plug-connector part according to the preamble of the independent claim 1.

The currently-available coaxial plug connectors known by their designations as N-, 2.92 mm-, SMA, 1 mm-, 1.85 mm-, 3.5 mm- or 2.4 mm-plugs or as so-called hermaphrodite connectors with the designation PC7, consist, as shown in FIG. 1, of a plug part 1 and a bush part 2. The plug 1 consists of an outer conductor 3, in which the inner conductor 5 is arranged in a coaxial manner via a supporting washer 4. The coaxial line consists of an inner conductor 5 and an outer conductor 3 and opens at the rear of the plug 1 into a device 15, which is not illustrated in greater detail, and is connected there to electronic components, which are also not illustrated. A cap nut 6, which is generally connected via a snap ring 7 in an axial, force-fit manner to the outer conductor 3, is placed in a rotatable manner on the outer conductor 3. The internal thread 8 of this cap nut 6 must be screwed onto the external thread 9 of the bush 2 until the annular end-face contact surface 10 of the outer conductor 3 of the plug 1 contacts the corresponding annular end-face contact surface 11 of the bush 2, thereby establishing the coaxial connection. In this context, the tip 12 of the inner conductor 5 is inserted into the radially sprung, sleeve-shaped bush 13 of the bush part 2.

With the use of such coaxial plug connectors in devices 15 with extremely temperature-sensitive electronic components, such as is the case, for example, in a test probe for thermal power measurement of high-frequency signals with a thermal power measuring cell built into the test probe, it must be ensured that the minimum possible interfering heat from externally reaches the interior of the device via the plug part 1 and the outer conductor 3 of the coaxial line. Even heat, which is supplied to the plug part 1 through the contact of the user's hand with the cap nut 6, and the heat supplied via the end-face contact surface 10 of the outer conductor 3 must be kept away from the thermally sensitive electronic components of the device 15.

With a coaxial plug connector of the type described, the object of the invention is therefore to minimise as far as possible the transfer of heat from the plug to the device.

This object is achieved for a coaxial plug connector part by the features of claim 1 or claim 9. Advantageous further developments are specified in the dependent claims.

Through the thermal decoupling according to the invention between the mutually contacting surfaces of the cap nut and the outer conductor of the coaxial line, the transfer of interfering heat from externally via the cap nut of the plug part to the thermally sensitive components in the interior of the device connected to the plug part is avoided. With commercially available coaxial plug connectors as shown in FIG. 1, in which the axial force-fit connection between the cap nut and the outer conductor is achieved via a sprung ring, this can be achieved simply, for example, in that this sprung ring or the opposing surfaces of the cap nut and outer conductor are made of a synthetic material of poor thermal conductivity.

With such known plug-connector parts, in which the frictional torque of the axial force-fit connection between the cap nut on the outer conductor is selected to be smaller than the frictional torque between the outer conductor end-face contact surfaces of the plug connector, the principle according to the invention has proved particularly advantageous and, in fact, because the axial force-fit connection between the cap nut and the outer conductor is implemented via at least one roller bearing, for example, a ball bearing, roller bearing or needle bearing. In this context, reference is made to EP 0 327 204 B1. Advantageous embodiments of the thermal decoupling for such special coaxial plug-connector parts with additional roller bearings are specified in the dependent claims and the description below.

Exemplary embodiments of the invention are described in greater detail below with reference to the drawings. The drawings are as follows.

Figure 1:
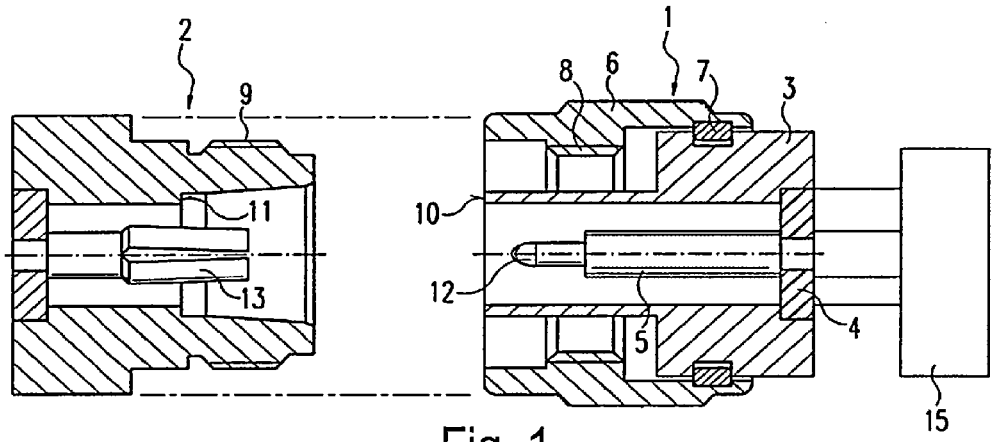
Fig. 1 (PRIOR ART)
FIG. 1 shows a section through a known plug connector in an extremely enlarged scale.
Figure 2:
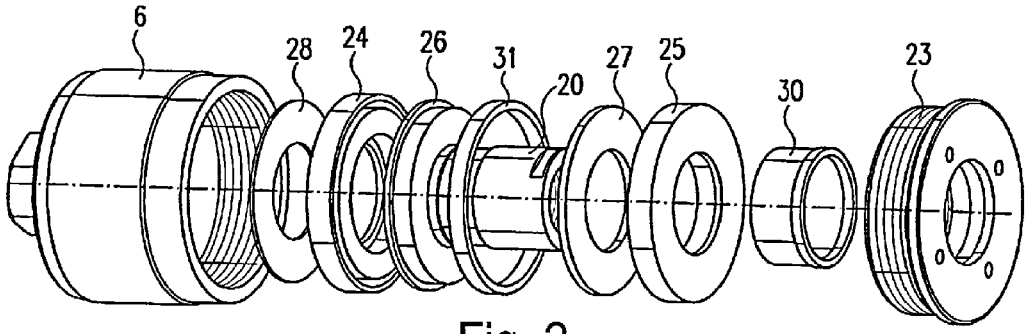
FIG. 2 shows an exploded view of the individual parts of a coaxial plug-connector part with built-in roller bearings.
Figure 3:
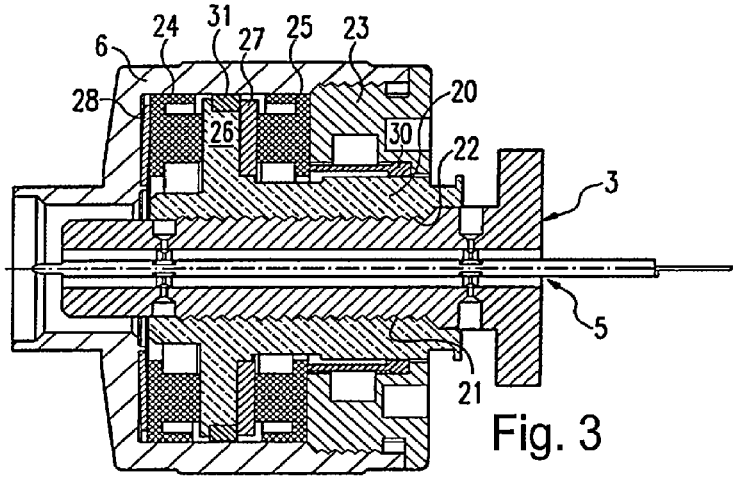
FIG. 3 shows the plug-connector part illustrated in FIG. 2 in the assembled condition.

FIGS. 2 and 3 show a structure of a coaxial plug-connector part, in which two needle bearings 24, 25 are provided to reduce the frictional coefficients between the cap nut 6 and a bearing bush 20 screwed onto the outer conductor 3 of the coaxial line.

The bearing bush 20 is preferably made, like the cap nut 6, of stainless steel. The bearing bush 20 provides a continuous internal borehole, into which the end of the coaxial line system to be connected can be plugged and screwed, for example, via an external thread 21 formed on the outer conductor 3 of the coaxial line system, into an internal thread 22 of this continuous borehole of the bearing bush. A bearing cover 23 can be screwed into the open end of the pot-shaped cap nut 6. The roller bearings provided for the reduction of the frictional torque of the axial force-fit connection between the cap nut 6 and the bearing bush 20 are formed in the exemplary embodiment as needle bearings 24 and 25. They are placed at both sides of the annular flange 26 formed on the bearing bush 20 on corresponding cylindrical portions of the bearing bush 20. Additional running washers may optionally be arranged between the needle bearings 24 or respectively 25 and the end-face surfaces of the annular flange 26, on which the needle bearings roll, as indicated in FIG. 2 by the running washers 27.

To ensure that no play can exist between the co-operating components even when the plug connection is released, a further plate spring 28 is preferably arranged between the base of the cap nut 6 and the first axial bearing 24 following it. In the assembled condition according to FIG. 3, the cap nut 6 closed with the cover 23 forms, together with the bearing bush 20 arranged in the interior of the cap nut and the axial bearings 24, 25 cooperating with it, an enclosed module, which can be prefabricated independently and is only screwed onto the end of the coaxial line system 3, 5 directly upon use or assembly. This enclosed module can be placed onto the outer conductor 3 of the coaxial line system from the front, this also considerably facilitates assembly. In the context of servicing, the module can also be very readily disassembled from the coaxial line system and optionally replaced with a new module.

To minimise the transfer of heat between the cap nut 6 and the bearing bush 20 screwed onto the outer conductor of the coaxial line in a plug-connector part of this kind, a synthetic-material ring 30 is placed onto the metal bearing bush, thereby thermally decoupling the bearing bush 20 from the metal bearing cover 23 screwed into the cap nut 6. Additionally, a synthetic-material ring 31 is inserted into a corresponding groove on the outer circumference of the annular flange 26 of the metal bearing bush, so that this flange 26 is also thermally decoupled from the externally surrounding internal wall of the cap nut 6. A metallic connection exists only at the points of contact of the roller elements.

Figure 4:
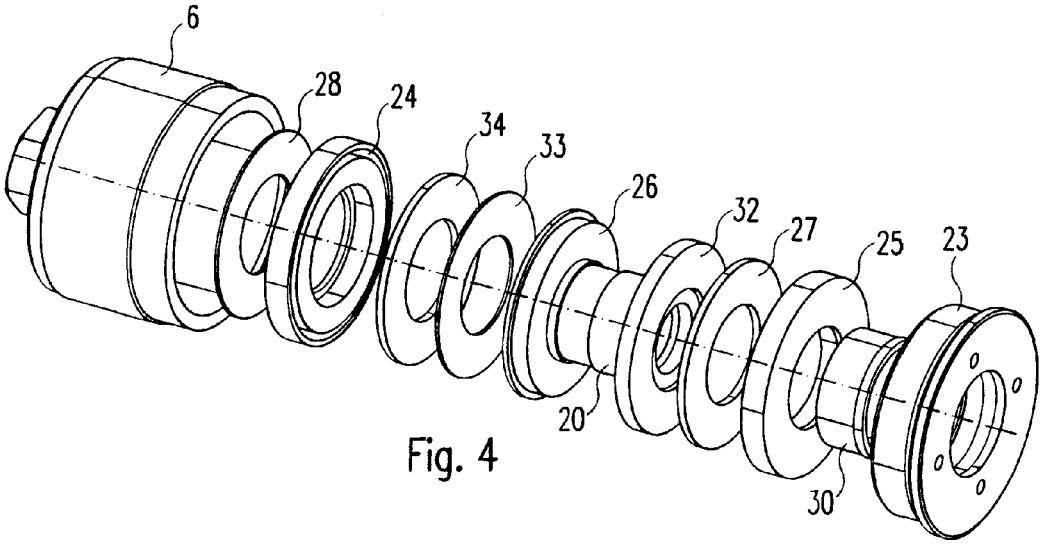
FIG. 4 shows a further example of a plug-connector part of this kind with built-in roller bearings.

FIG. 4 shows further options for thermal decoupling between the individual parts of a coaxial plug connector as illustrated in FIG. 2. The structure with the two needle bearings corresponds to that shown in FIGS. 2 and 3; two synthetic-material rings 32 and 33, which lie flat on the end-face sides of the annular flange 26 of the bearing bush and insulate this thermally, are provided in addition to the synthetic-material sleeve 30. An axially projecting annular flange, which corresponds to the insulating ring 31 in FIG. 2 and insulates the outer annular edge of the flange 26, is also provided on the washer 32, at the top. Between the bearing 24 and the annular flange 26, in the exemplary embodiment according to FIG. 4, an additional annular washer 34 is also provided as a running surface for the bearing 24, which can be dispensed with in the embodiment of the synthetic-material ring 33 made of a high-strength synthetic material. The same applies for the bearing washer 27.

Figure 5:
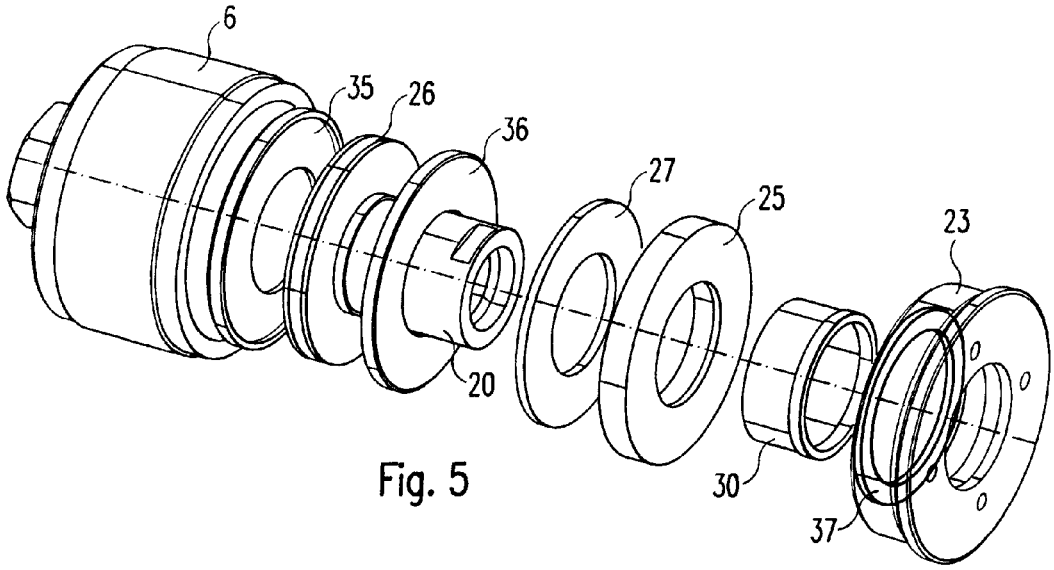
FIG. 5 shows a plug-connector part with only one roller bearing and an additional sliding bearing.

FIG. 5 finally shows an exemplary embodiment of a coaxial plug-connector part with only a single needle bearing 25. Here also, a synthetic-material ring 30 is provided for thermal insulation between the bearing cover 23 and the bearing bush 20. Instead of the second needle bearing as shown in FIG. 2 or respectively 4, in FIG. 5, a synthetic-material washer 35, which once again engages over the outer edge of the annular flange 26, is arranged between the base of the cap nut 6 and the annular flange 26 of the bearing bush 20 with an axially projecting edge. From the other side, a corresponding washer 36 made of insulating material, which covers the other half of the annular flange 26 via an annular edge, is arranged on the bearing bush 20. These two synthetic-material washers are used, on one hand, for thermal decoupling between the cap nut 6 and the bearing bush 20 and, at the same time, as a sliding bearing to reduce the frictional coefficients. A corrugated spring washer 37 of the bearing cover 23 in this exemplary embodiment prevents play between the components.

In the preceding exemplary embodiments, both the cap nut 6 and also the bearing bush 20 screwed onto the outer conductor 3 are made of high-strength metal, for example, stainless steel. The thermal decoupling between the cap nut and the bearing bush can also be achieved according to a further development of the invention in that either the cap nut 6 and/or the bearing bush 20 consist of high-strength synthetic material, for example, a fibre-glass reinforced synthetic material, of which the synthetic-material parts used in the exemplary embodiment according to FIGS. 2-5 are also preferably manufactured.

With the measures illustrated, a thermal decoupling between the cap nut 6 and the outer conductor 3 of the coaxial line is in fact achieved; however, a direct transfer of heat to the end-face contact surface 10 and therefore also to the outer conductor 3 of the plug 1, which reaches the bush 2 via the end-face contact surface 11 of the outer conductor, can accordingly not be prevented. In order to minimise such a direct transfer of heat of this kind to the outer conductor 3 of the coaxial line leading to the device, the part of the outer conductor 3, which is screwed directly into the bearing bush 20 is manufactured from a material with poor thermal conductivity, for example, stainless steel (Niro 1.4305). The temperature gradients in the interior of the device 15 can be further reduced in that the part of the outer conductor 3, in which the thermally sensitive components of the device 15 are inserted, is made from a material with good thermal conductivity, such as copper (for example, E-Cu 57F30).

These two outer conductor parts are preferably connected to one another in a homogeneous manner using a frictional welding method, as indicated schematically in FIG. 2 by the point of separation 38. In this manner, heat transferred directly to the outer conductor is kept away from the thermally sensitive components of the device 15 or reduced by the front, outer conductor with poor thermal conductivity. The thermal insulation through the combination of materials of good and poor thermal conductivity in the outer conductor 3 can also be used independently of the thermal decoupling of the cap nut.

The invention is not restricted to the exemplary embodiment presented. All of the features described and/or illustrated can be combined with one another as required within the framework of the invention.

The invention claimed is:

1. A coaxial plug-connector part with a metal cap nut arranged in a rotatable manner on a metal outer conductor wherein between the mutually contacting surfaces of the cap nut and the outer conductor, means are provided for their thermal decoupling, which include a material with poor thermal conductivity arranged between the cap nut and the outer conductor, wherein, for the reduction of the frictional torque between the cap nut and the outer conductor, at least one roller bearing is provided, which is arranged on a bearing bush, which can be placed via an internal borehole on the outer conductor, and wherein the means for thermal decoupling between the cap nut and the outer conductor includes additional components made of a synthetic material of poor thermal conductivity arranged between the mutually contacting surfaces of the cap nut and the bearing bush.

2. The plug-connector part according to claim 1, wherein the material with poor thermal conductivity is a synthetic material.

3. The plug-connector part according to claim 1, wherein a synthetic-material ring is placed on the portion of the metallic bearing bush accommodating the roller bearing.

4. The plug-connector part according to claim 1, wherein a synthetic-material ring is placed on the flange on the outer circumference of the bearing bush co-operating with the roller bearings.

5. The plug-connector part according to claim 1, wherein additional synthetic-material washers are arranged between the roller bearings and the ring flange of the bearing bush.

6. The plug-connector part according to claim 1, wherein the cap nut and/or bearing bush include a high-strength synthetic material.

7. The plug-connector part according to claim 2, wherein the synthetic material includes a fiber-glass reinforced synthetic material.

8. A coaxial plug-connector part with a metal cap nut arranged in a rotatable manner on a metal outer conductor wherein between the mutually contacting surfaces of the cap nut and the outer conductor, means are provided for their thermal decoupling, which include a material with poor thermal conductivity arranged between the cap nut and the outer conductor, wherein only one roller bearing is arranged on a bearing bush, and synthetic-material washers are provided on both sides of the ring flange of the bearing bush for thermal decoupling with a simultaneous sliding-bearing property.

9. A coaxial plug-connector, comprising:

a metal outer conductor;

a cap nut arranged in a rotatable manner on a metal outer conductor;

a bearing bush positioned in surrounding relation with and supported by a segment of the outer conductor;

at least one roller bearing arranged between the bearing bush and the cap nut, the at least one roller bearing configured to reduce the frictional torque between the cap nut and the outer conductor;

a thermal decoupler configured and arranged so as to thermally decouple the metal outer conductor from the cap nut, wherein the thermal decoupler includes one or more synthetic components of poor thermal conductivity positioned and arranged between mutually contacting surfaces of the cap nut and the bearing bush.

10. The coaxial plug-connector according to claim 9, wherein the bearing bush includes a fiber-glass reinforced synthetic material, the bearing bush forming at least a portion of the thermal decoupler.

11. The coaxial plug-connector according to claim 9, wherein the bearing bush is fastened to the segment of the outer connector.

* * * * *